US007210905B2

(12) United States Patent
Lapworth

(10) Patent No.: US 7,210,905 B2
(45) Date of Patent: May 1, 2007

(54) COMPRESSOR HAVING CASING TREATMENT SLOTS

(75) Inventor: Bryan L Lapworth, Derby (GB)

(73) Assignee: Rolls-Royce plc, London (GB)

( * ) Notice: Subject to any disclaimer, the term of this patent is extended or adjusted under 35 U.S.C. 154(b) by 81 days.

(21) Appl. No.: 10/992,834

(22) Filed: Nov. 22, 2004

(65) Prior Publication Data

US 2005/0111968 A1 May 26, 2005

(30) Foreign Application Priority Data

Nov. 25, 2003 (GB) ..... 0327337.2

(51) Int. Cl.
*F03D 11/02* (2006.01)
*F01D 25/24* (2006.01)

(52) U.S. Cl. ..... 415/220; 415/914

(58) Field of Classification Search ..... 415/57.4, 415/220, 221, 904, 58.3, 58.7, 186
See application file for complete search history.

(56) References Cited

U.S. PATENT DOCUMENTS 3,580,692 A * 5/1971 Mikolajczak ..... 415/173.4
4,239,452 A * 12/1980 Roberts, Jr. ..... 415/173.5
5,282,718 A * 2/1994 Koff et al. ..... 415/57.3
5,586,859 A * 12/1996 Nolcheff ..... 415/58.5
6,290,458 B1 * 9/2001 Irie et al. ..... 415/119
2003/0152455 A1 8/2003 James

FOREIGN PATENT DOCUMENTS

GB 2245312 A 1/1992

* cited by examiner

*Primary Examiner*—Edward K. Look
*Assistant Examiner*—Devin Hanan
(74) *Attorney, Agent, or Firm*—W. Warren Taltavull; Manelli Denison & Selter PLLC

(57) ABSTRACT

A compressor (16) comprises a rotor (40) having a plurality of circumferentially spaced radially outwardly extending rotor blades (42). A casing (44) surrounds the rotor (40) and rotor blades (42). The casing (44) has an inner surface (48) and a plurality of circumferentially spaced slots (50) are provided in the inner surface (48) of the casing (44). Each slot (50) has a length (L), a depth (D), a width (W), an angle (θ) of inclination relative to the radial direction, an axial position (AP) relative to the rotor blades (42) and a circumferential position (CP) relative to an adjacent slot (50). The slots (50) are arranged such that at least one of the length (L), depth (D), width (W), angle (θ) of inclination relative to the radial direction, axial position (AP) relative to the rotor blades (42) and circumferential position (CP) relative to an adjacent slot (50) varies circumferentially around the casing (44).

12 Claims, 5 Drawing Sheets

COMPRESSOR HAVING CASING TREATMENT SLOTS

FIELD OF THE INVENTION

The present invention relates to a compressor having casing treatment slots and in particular to a turbofan gas turbine engine compressor having casing treatment slots.

BACKGROUND OF THE INVENTION

Conventionally casing treatment slots are provided on the inner surface of a compressor casing, or a fan casing, around the tips of the compressor blades, or fan blades, to extend the stable flow range over which the compressor, or fan may operate.

Typically casing treatment slots are provided around the first stage of compressor blades or around the fan blades.

Our UK patent GB1518293 discloses a compressor casing treatment comprising a plurality of circumferentially spaced slots in the inner surface of the compressor casing and around a stage of compressor blades. The slots are arranged at an angle to the axis of rotation of the compressor blades.

Our UK patent GB2245312B discloses a compressor casing treatment comprising a plurality of circumferentially spaced slots in the inner surface of the compressor casing and around a stage of compressor blades. The slots are arranged at an angle to the axis of rotation of the compressor blades. The slots are also arranged at an angle to the radial direction. The upstream edges of the slots are upstream of the leading edges of the compressor blades and the trailing edges of the slots are upstream of the trailing edges of the slots.

In each of these arrangements the slots are identical, they have the same length, the same depth, the same width, the same angle of inclination to the axis of rotation and the same angle of inclination to the radial direction etc.

However, the compressor casing suffers from cracking of the webs, the pieces of compressor casing circumferentially between the compressor casing treatment slots. It is believed that the cracking of the webs occurs due to the unsteady pressure acting on them due to the periodic passing of the compressor blades. All the slots are identical and have the same geometry and thus they experience the same unsteady pressure variations but with a time lag related to the passing frequency of the compressor blades. In adjacent slots there will be a time lag between the pressure variations and thus the pressure variations are out of phase and this results in a pressure difference across the webs. Additionally because all the compressor blades are substantially identical and all the casing treatment slots are substantially identical, the presence of an incoming distortion may substantially increase the unsteady forces on the rotor creating further phase differences within the casing treatment slots and thence unsteady forces on the webs.

SUMMARY OF THE INVENTION

Accordingly the present invention seeks to provide a compressor having a novel arrangement of casing treatment slots.

Accordingly the present invention provides a compressor comprising a rotor having a plurality of circumferentially spaced radially outwardly extending rotor blades, a casing surrounding the rotor and rotor blades, the casing having an inner surface, a plurality of circumferentially spaced slots in the inner surface of the casing, each slot having a length, a depth, a width, an angle of inclination relative to the radial direction, an axial position relative to the rotor blades and a circumferential position relative to an adjacent slot, wherein the slots are arranged such that at least one of the length, depth, width, angle of inclination relative to the radial direction, axial position relative to the rotor blades and circumferential position relative to an adjacent slot varies circumferentially around the casing.

Preferably the depth of the slots varies circumferentially around the casing.

Preferably inserts having different depths are provided in the slots to vary the depth of the slots circumferentially around the casing.

The slots may be arranged such that at least two of the length, depth, width angle of inclination relative to the radial direction, axial position relative to the rotor blades and circumferential position relative to an adjacent slot varies circumferentially around the casing.

Each of the depth, width, angle of inclination relative to the radial direction and circumferential position relative to an adjacent slot may be varied circumferentially around the casing.

Each of the length, depth, width, angle of inclination relative to the radial direction, axial position relative to the rotor blades and circumferential position relative to an adjacent slot varies circumferentially around the casing.

Preferably the leading edges of the slots are arranged upstream of the leading edges of the rotor blades.

The radially outer ends of the slots may be connected to an annular chamber.

BRIEF DESCRIPTION OF THE DRAWINGS

The present invention will be more fully described by way of example with reference to the accompanying drawings in which.

DETAILED DESCRIPTION OF THE INVENTION

Figure 1:
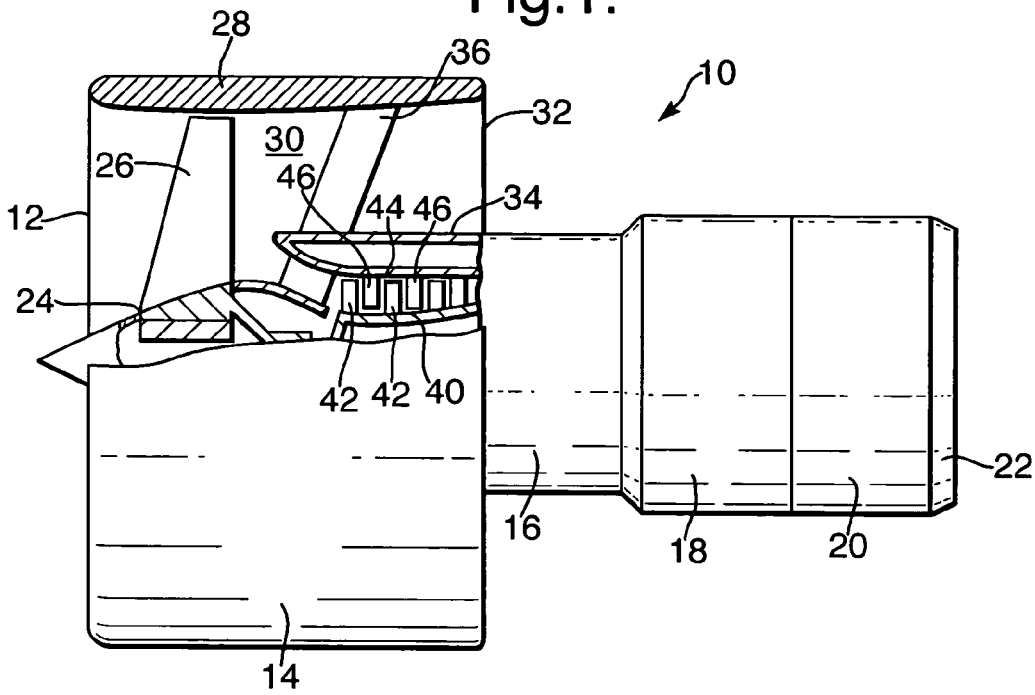
FIG. 1 is a partially cut away view of a turbofan gas turbine engine having a compressor according to the method of the present invention.

A turbofan gas turbine engine 10, as shown in FIG. 1, comprises in axial flow series an intake 12, a fan section 14, a compressor section 16, a combustion section 18, a turbine section 20 and an exhaust 22.

The turbine section 20 comprises one or more turbines (not shown) arranged to drive a fan rotor 24 via a shaft (not shown) and one or more turbines (not shown) arranged to drive one or more compressor rotors 40 via one or more shafts (not shown).

The fan section 14 comprises the fan rotor 24 and a plurality of circumferentially spaced radially outwardly extending fan blades 26 are carried on the fan rotor 24. The fan rotor 24 and fan blades 26 are surrounded by a fan casing 28, which is arranged coaxially with the fan rotor 24. The fan casing 28 partially defines a fan duct 30 and the fan duct 30 has an outlet 32 at its downstream end. The fan casing 28 is secured to a core engine casing 34 by a plurality of circumferentially spaced radially extending fan outlet guide vanes 36.

The compressor section 16 comprises a compressor rotor 40, which carries a plurality of stages of compressor blades 42 and each stage of compressor blades 42 comprises a plurality of circumferentially spaced radially outwardly extending compressor blades 42. The compressor rotor 40 and compressor blades 42 are surrounded by a compressor casing 44 which is arranged coaxially around the compressor rotor 40 and compressor blades 42. The compressor casing 44 also supports a plurality of stages of compressor vanes 46 and each stage of compressor vanes 46 comprises a plurality of circumferentially spaced radially inwardly extending compressor vanes 46. The stages of compressor vanes 46 and the stages of compressor blades 42 are arranged alternately through the compressor section 16.

The turbofan gas turbine engine 10 operates conventionally and its operation will not be discussed further.

Figure 2:
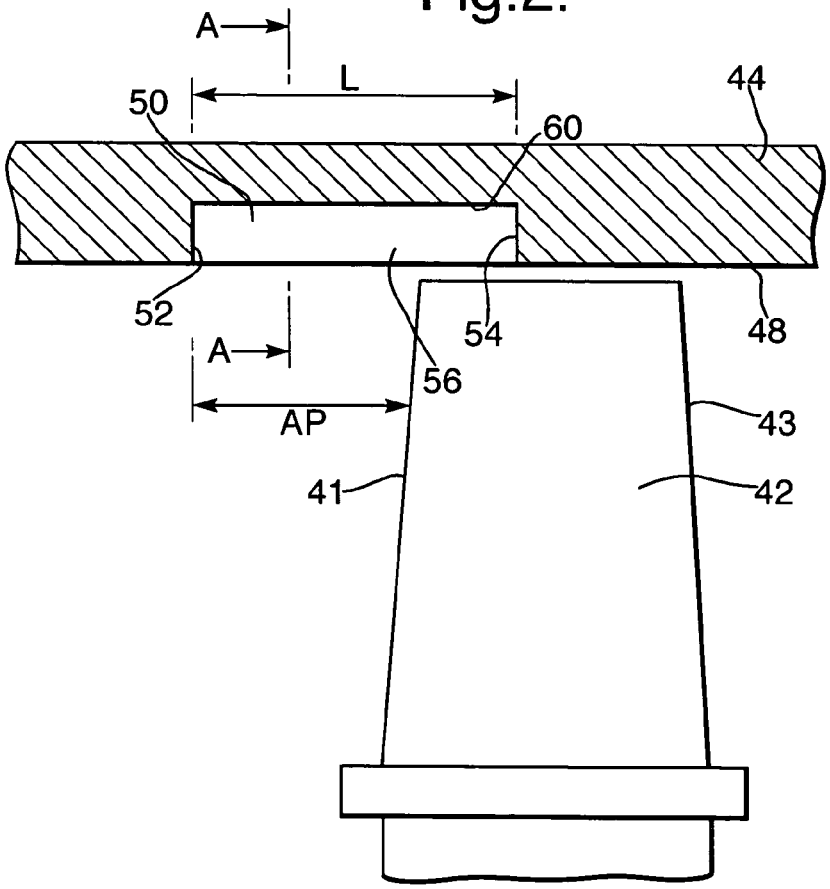
FIG. 2 is an enlarged cross-section view of through the compressor casing shown in FIG. 1.

The compressor casing 44, as shown more clearly in FIG. 2 has an inner surface 48 and that portion of the inner surface 48 immediately around one of the stages of compressor blades 42 has a plurality of circumferentially spaced slots 50. Each slot 50 has a leading edge wall 52, a trailing edge wall 54, a first side wall 56, a second side wall 58 and an end wall 60. The compressor casing comprises webs 51 between the slots 50. The slots 50 may be around one or more stages of compressor blades 42 in a low-pressure compressor, e.g. the fan, an intermediate-pressure compressor and/or a high-pressure compressor.

Each slot 50 has an axial length L between the leading edge wall 52 and the trailing edge wall 54, a radial depth D between the inner surface 54 48 and the end wall 60, a width W between the first side wall 56 and the second side wall 58, an angle θ of inclination relative to the radial direction, an axial position AP relative to the rotor blades 42 and a circumferential position CP relative to an adjacent slot 50.

The axial position AP of the slots 50 is measured between the arc scribed by the leading edges 41 of the compressor blades 42 and any suitable position of the slot 50, for example the leading edge 52 or the trailing edge 54 or the axial position AP is measured between the arc scribed by the trailing edges 43 of the compressor blades 42 and any suitable position of the slot 50 as mentioned above. The circumferential position CP of the slots 50 is measured between the circumferential mid positions of the adjacent slots 50 or is measured between first sides 56, or second sides 57, of the slots 50.

Figure 3:
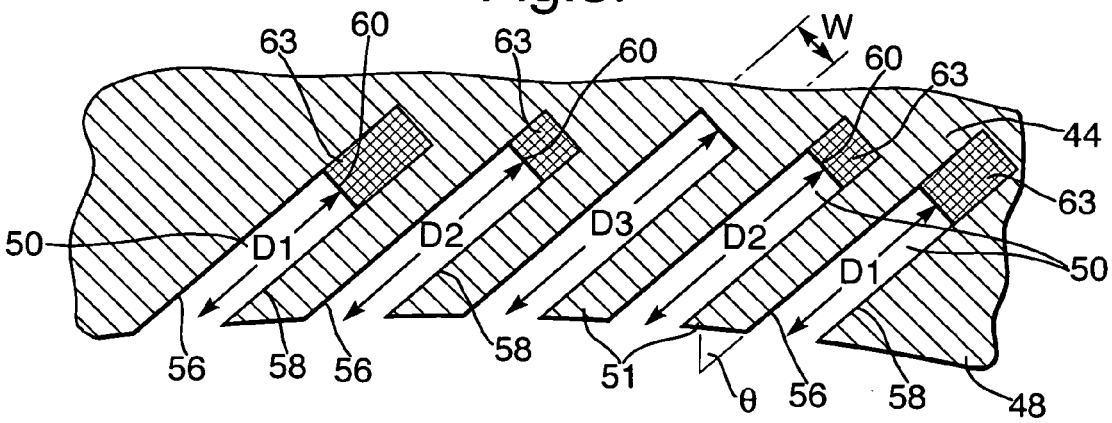
FIG. 3 is an enlarged cross-section view in the direction of arrows A—A in FIG. 2.

As shown in FIG. 3 the depth D of the slots 50 varies circumferentially around the compressor casing 44. The slots 50 have varying depths D1, D2, D3 etc and in this case D3>D2>D1. It is easier to manufacture casing treatments with identical slots 50 and to aid manufacture the slots 50 are preferably machined to the same depth and a set of inserts 63 of varying depth are then inserted and secured into the slots 50. The inserts 63 have the same length L and width W as the slots 50. The slots 50 all have the same length L, width W, angle θ of inclination, circumferential position CP and axial position AP.

Figure 4:
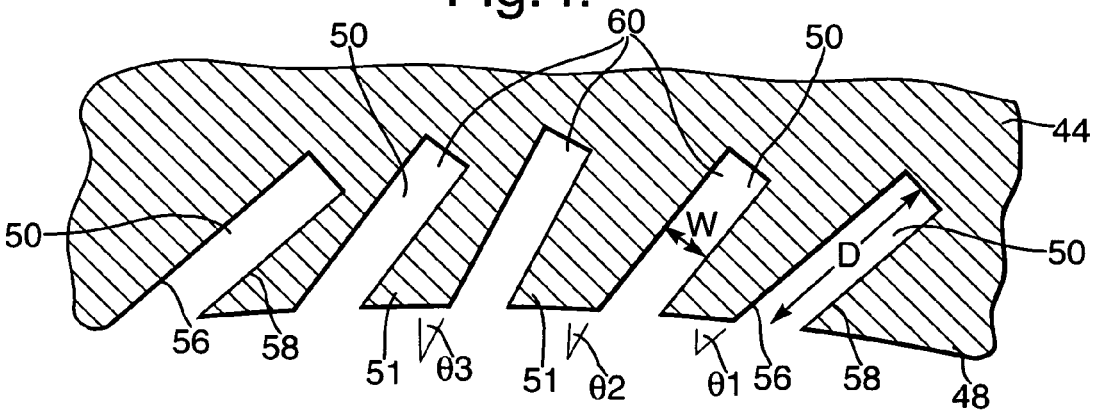
FIG. 4 is an alternative enlarged cross-section view in the direction of arrows A—A in FIG. 2.

As shown in FIG. 4 the angles θ of inclination relative to the radial direction of the slots 50 varies circumferentially around the compressor casing 44. The slots 50 have varying angles θ1, angles θ2 angles θ3 and in this case θ1>θ2>θ3. The slots 50 all have the same length L, width W, depth D, circumferential position CP and axial position AP.

Figure 5:
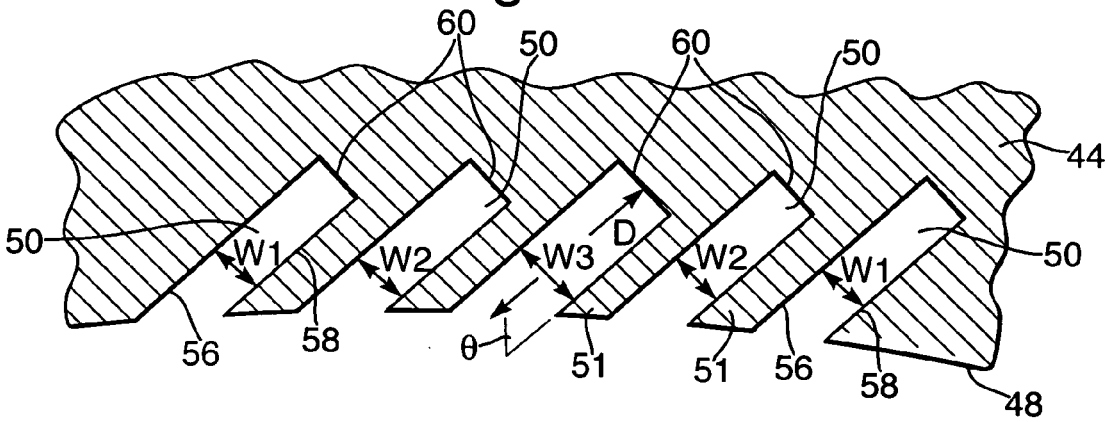
FIG. 5 is a further alternative enlarged cross-section view in the direction of arrows A—A in FIG. 2.

As shown in FIG. 5 the width W of the slots 50 varies circumferentially around the compressor casing 44. The slots 50 have varying width W1, W2, W3 etc and in this case W3>W2>W1. The slots 50 all have the same length L, depth D, angle θ of inclination, circumferential position CP and axial position AP.

Figure 6:
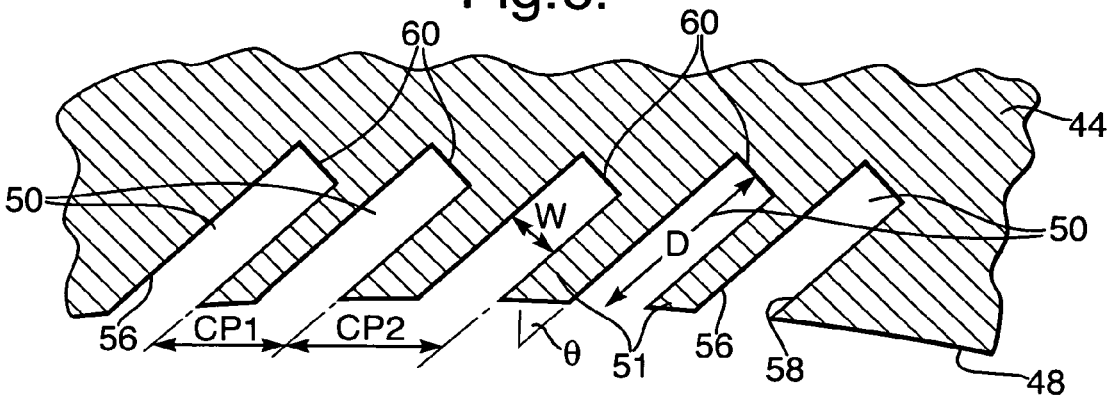
FIG. 6 is another alternative enlarged cross-section view in the direction of arrows A—A in FIG. 2.

As shown in FIG. 6 the circumferential position CP of the slots 50 relative to adjacent slots 50 varies circumferentially around the compressor casing 44. The slots 50 have varying circumferential positions CP1, CP2 etc where CP2>CP1. The slots 50 all have the same length L, depth D, width W, angle θ of inclination and axial position AP.

Figure 7:
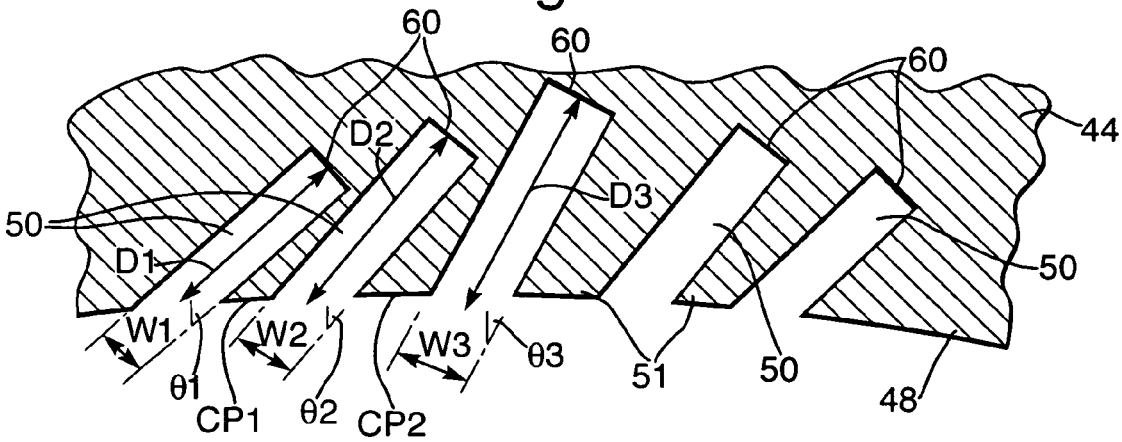
FIG. 7 is an additional alternative enlarged cross-section view in the direction of arrows A—A in FIG. 2.

As shown in FIG. 7 the depth D of the slots 50, the angles θ of inclination relative to the radial direction of the slots 50, the width W of the slots 50 and the circumferential position CP of the slots 50 relative to adjacent slots 50 varies circumferentially around the compressor casing 44. The slots 50 have depths D1, D2 and D3, widths W1, W2 and W3 angles θ1, θ2 and θ3 and circumferential positions CP1, CP2. The slots 50 have the same lengths L and axial positions AP.

Figure 8:
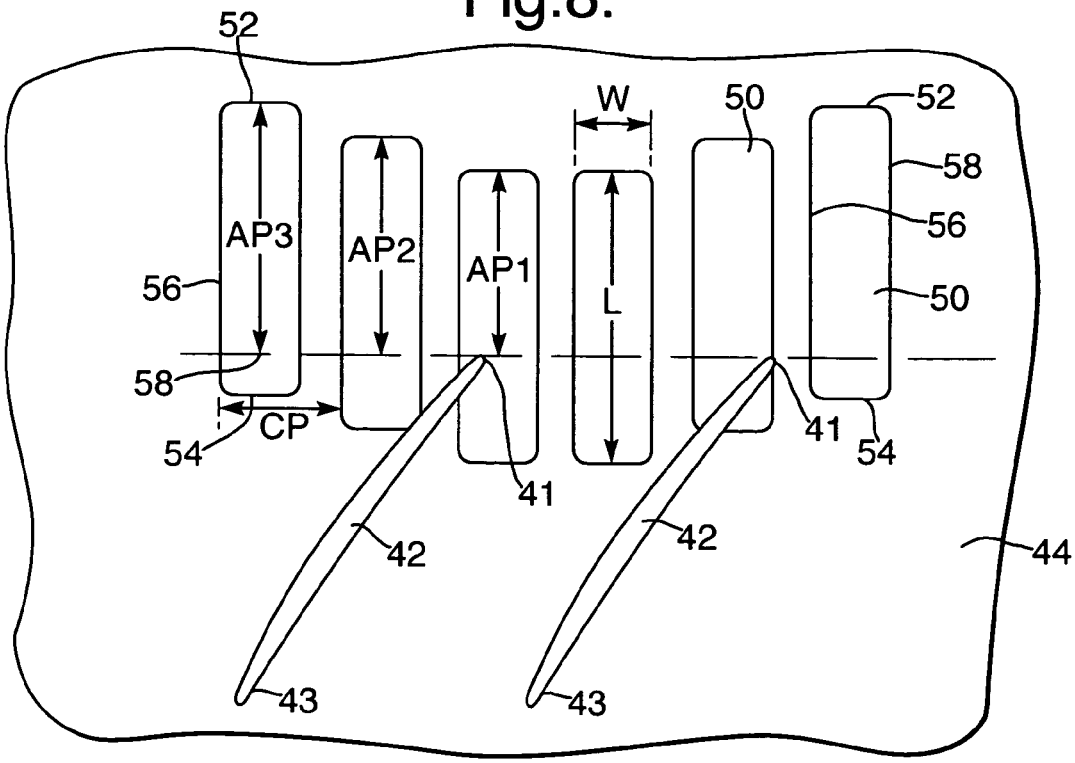
FIG. 8 is a view in the direction of arrow B in FIG. 2.

As shown in FIG. 8 the axial position AP of the slots 50 varies circumferentially around the compressor casing 44. The slots 50 have varying axial positions AP1, AP2 and AP3 relative to the arc scribed by the leading edges 41 of the compressor blades 42, where AP1>AP2>AP3. The slots 50 all have the same depth D, length L, width W, angle θ of inclination and circumferential position CP.

Figure 9:
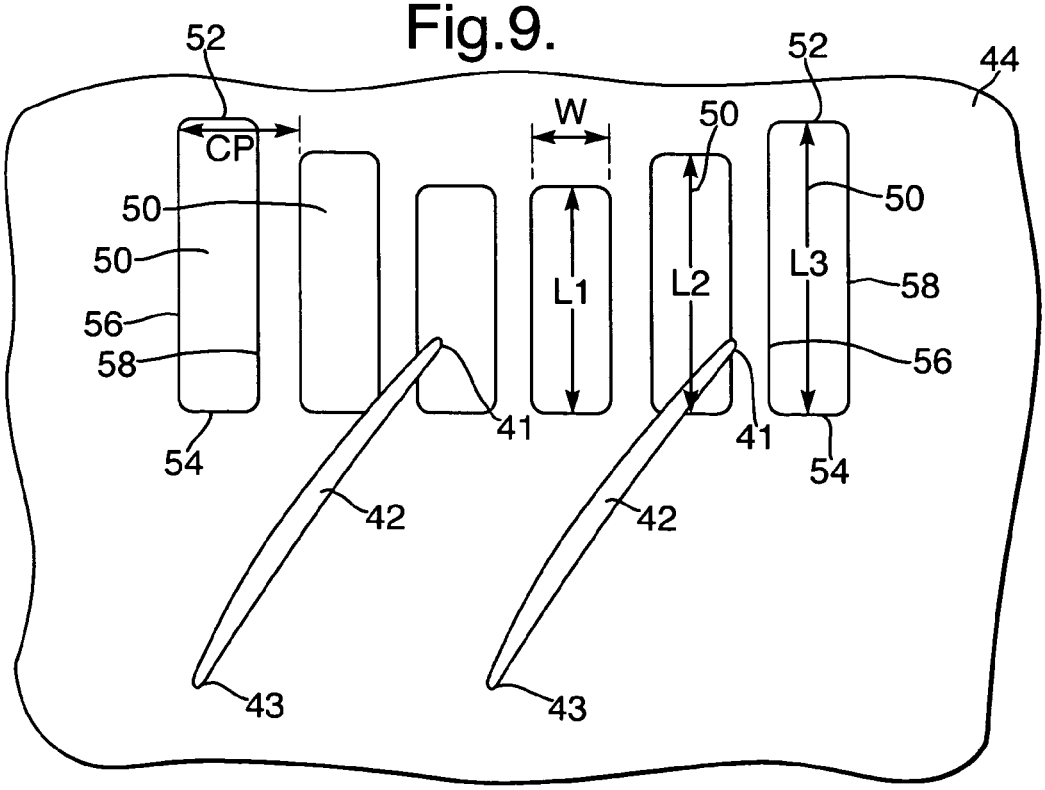
FIG. 9 is an alternative view in the direction of arrow B in FIG. 2.

As shown in FIG. 9 the axial length L of the slots 50 varies circumferentially around the compressor casing 44. The slots 50 have varying lengths L1, L2 and L3, where L3>L2>L1. The slots 50 all have the same depth D, width W, angle θ of inclination, circumferential position CP and axial position AP.

The main advantage of the present invention is that the non-uniform slot geometry modifies the unsteady pressures in adjacent slots so that there is no longer a simple phase lag relationship between them. The unsteady pressure is modified in adjacent slots to reduce the peak cyclic force and hence reduce the likelihood that the webs will crack.

An additional advantage of the present invention is that the non-uniform slot geometry may be used to counteract the effect of non-uniformities in the incoming airflow into the compressor. In the case of distortion of the air flow into the compressor the compressor rotor and compressor blades experience an unsteady force and the compressor rotor performance, shock pattern, changes as it experiences the inlet distortion. If the compressor rotor shock pattern variation due to inlet distortion is known, it may be possible to arrange the casing treatment slots to improve the compressor rotor performance. The inlet distortion may also lead to high unsteady forces on some of the webs, which may be counteracted by the present invention.

Although the present invention has been described with reference to a compressor casing treatment it is equally applicable to a fan casing treatment.

Although the present invention has been described with reference to slots arranged at an angle to the radial direction it is equally possible to apply the present invention to casing treatment slots, which are not arranged at an angle of 0° to the radial direction. Similarly the casing treatment slots may extend purely with an axial component or may be helical, arranged at an angle to the axial direction. Additionally, although the present invention has been described with reference to the leading edge of the slots being arranged upstream of the leading edge of the rotor blades it may be possible for the leading edge of the slots to be arranged substantially in the same plane as the leading edge of the slots or perhaps downstream of the leading edge of the slots.

The slots may be any suitable shape in axial cross-section, for example rectangular as shown in the figures, or they may be curved.

The present invention is also applicable to casing treatments as disclosed in published European patent application EP0688400A, in which the radially outer ends of the casing treatment slots are connected to an annular chamber. The annular chamber may be uniform circumferentially around the casing.

Figure 10:
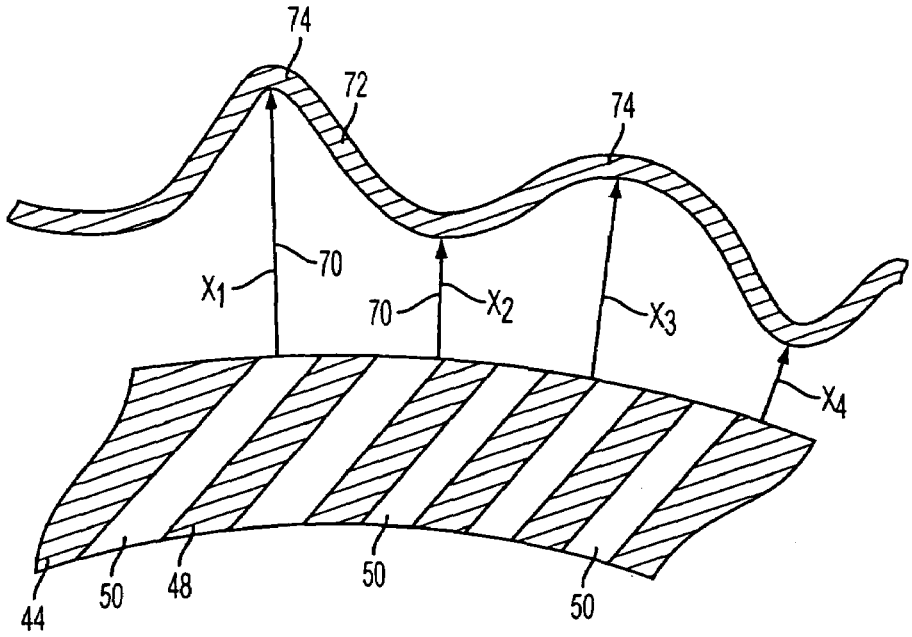
FIG. 10 is a cross sectional view of a portion of a compressor casing according to the present invention.

Alternatively the radially outer wall 72 of the annular chamber 70, as shown in FIG. 10, may have axially extending corrugations 74 circumferentially spaced around the casing and the corrugations 74 comprise super-positioned sine waves such that the radial depth of the annular chamber 70 varies circumferentially in a non-uniform manner, as illustrated by the changes in length of $X_1$, $X_2$, $X_3$ and $X_4$, and/or the circumferentially spacing between the corrugations 74 varies circumferentially around the casing.

Alternatively the outer wall of the annular chamber may have circumferentially extending corrugations axially spaced along the casing and the corrugations comprise super-positioned sine waves such that the radial depth of the annular chamber varies circumferentially in a non-uniform manner and/or the axial spacing between the corrugations varies circumferentially around the casing.

Additionally it may be possible to provide a casing treatment in which each slot has a length, a depth, a width, an angle of inclination relative to the radial direction, an axial position relative to the rotor blades and a circumferential position relative to an adjacent slot and these are the substantially the same for all the slots.

Preferably, the radially outer wall of the annular chamber has axially extending corrugations circumferentially spaced around the casing and the corrugations comprise super-positioned sine waves such that the radial depth of the annular chamber varies circumferentially in a non-uniform manner. Thus the radial depth of the corrugations and/or the circumferential spacing between the corrugations varies circumferentially around the casing.

Alternatively the outer wall of the annular chamber may have circumferentially extending corrugations axially spaced along the casing and the corrugations comprise super-positioned sine waves such that the radial depth of the annular chamber varies circumferentially in a non-uniform manner and/or the axial spacing between the corrugations varies circumferentially around the casing.

I claim:

1. A compressor comprising a rotor having a plurality of circumferentially spaced radially outwardly extending rotor blades, a casing surrounding the rotor and rotor blades, the casing having an inner surface, a plurality of circumferentially spaced axial slots in the inner surface of the casing, each slot having a length, a depth, a width, an angle of inclination relative to the radial direction, an axial position relative to the rotor blades and a circumferential position relative to an adjacent slot, wherein the slots are arranged such that at least one of the length, the depth, the width, the angle of inclination relative to the radial direction, the axial position relative to the rotor blades and the circumferential position relative to an adjacent slot varies circumferentially around the casing.

2. A compressor as claimed in claim 1 wherein the depth of the slots varies circumferentially around the casing.

3. A compressor as claimed in claim 1 wherein the slots are arranged such that at least two of the length, the depth, the width, the angle of inclination relative to the radial direction, the axial position relative to the rotor blades and circumferential position relative to an adjacent slot varies circumferentially around the casing.

4. A compressor as claimed in claim 1 wherein each of the depth, the width, the angle of inclination relative to the radial direction and the circumferential position relative to an adjacent slot varies circumferentially around the casing.

5. A compressor as claimed in claim 1 wherein each of the length, the depth, the width, the angle of inclination relative to the radial direction, the axial position relative to the rotor blades and the circumferential position relative to an adjacent slot varies circumferentially around the casing.

6. A compressor as claimed in claim 1 wherein the leading edges of the slots are arranged upstream of the leading edges of the rotor blades.

7. A compressor casing as claimed in claim 1 wherein the radially outer ends of the slots are connected to an annular chamber.

8. A compressor as claimed in claim 1 wherein the compressor is a fan, the rotor blades are fan blades and the compressor casing is a fan casing.

9. A gas turbine engine comprising a compressor as claimed in claim 1.

10. A compressor comprising a rotor having a plurality of circumferentially spaced radially outwardly extending rotor blades, a casing surrounding the rotor and rotor blades, the casing having an inner surface, a plurality of circumferentially spaced slots in the inner surface of the casing, each slot having a length, a depth, a width, an angle of inclination relative to the radial direction, an axial position relative to the rotor blades and a circumferential position relative to an adjacent slot, wherein the slots are arranged such that at least one of the length, the depth, the width, the angle of inclination relative to the radial direction, the axial position relative to the rotor blades and the circumferential position relative to an adjacent slot varies circumferentially around the casing wherein inserts having different depths are provided in the slots to vary the depth of the slots circumferentially around the casing.

11. A compressor comprising a rotor having a plurality of circumferentially spaced radially outwardly extending rotor blades, a casing surrounding the rotor and rotor blades, the casing having an inner surface, a plurality of circumferentially spaced slots in the inner surface of the casing, each slot having a length, a depth, a width, an angle of inclination relative to the radial direction, an axial position relative to the rotor blades and a circumferential position relative to an adjacent slot, the radially outer ends of the slots are connected to an annular chamber, wherein the radial depth of the annular chamber varies circumferentially around the casing.

12. A compressor as claimed in claim 11 wherein the slots are arranged such that at least one of the length, depth, width, angle of inclination relative to the radial direction, axial position relative to the rotor blades and circumferential position relative to an adjacent slot varies circumferentially around the casing.

* * * * *